US005565264A

United States Patent [19]

Howland

[11] Patent Number: 5,565,264

[45] Date of Patent: Oct. 15, 1996

[54] PROTECTIVE FABRIC HAVING HIGH PENETRATION RESISTANCE

[75] Inventor: Charles A. Howland, Weston, Mass.

[73] Assignee: Warwick Mills, Inc., New Ipswich, N.H.

[21] Appl. No.: 297,593

[22] Filed: Aug. 29, 1994

[51] Int. Cl.[6] ..... D03D 3/00

[52] U.S. Cl. ..... 428/229; 2/2.5; 139/383 R; 428/246; 428/252; 428/257; 428/902; 428/911

[58] Field of Search ..... 428/229, 252, 428/257, 902, 911; 2/2.5; 139/383 R

[56] References Cited

U.S. PATENT DOCUMENTS

| | | | |
|---|---|---|---|
| 4,737,401 | 4/1988 | Harpell et al. | 428/252 |
| 4,868,040 | 9/1989 | Hallal et al. | 428/251 |
| 5,198,280 | 3/1993 | Harpell et al. | 428/102 |
| 5,343,796 | 9/1994 | Cordova et al. | 89/36.02 |

*Primary Examiner*—James J. Bell
*Attorney, Agent, or Firm*—Wolf, Greenfield & Sacks, P.C.

[57] ABSTRACT

A protective fabric of high penetration resistance is formed from a plurality of layered, densely woven base fabrics, each formed by tightly weaving multifilament yarns to obtain a warp yarn "density" or "cover" in excess of 100% at the center of the fill yarn, and a fill yarn density or cover preferably also in excess of 75%. The yarns themselves preferably comprise a high modulus, high breaking strength yarn of materials such as Kevlar®, Spectran®, or Vectran®. The resultant layered fabric offers especially high penetration resistance to weapons such as ice picks and the like. Additional resistance to penetration by sharp knives is provided by interruptedly coating the base fabric with an epoxy in such a manner as to inhibit penetration while providing drapability and breathability.

30 Claims, 5 Drawing Sheets

| CONSTRUCTION | 110x52 | 131x65 | 70x70 | 110x66 | 110x88 | 90x88 | 90x68 |
|---|---|---|---|---|---|---|---|
| WARP | 200 5z t29 | 200 5z t15 | 200 | 200 5z t29 | 200 5z t29 | 200 5z t29 | 200 5z t29 |
| FILL | 750 0z t29 | 400 4z t29 | 200 0z t15 | 400 4z t29 | 200 10z t2 | 200 10z t2 | 400 4z t29 |
| | | | | | | | |
| | | | | | | | |
| | | | | | | | |
| **PUNCTURE 3:1** | | | | | | | |
| ASTM 4 LAYER PUNCTURE #'s | 105.30 | 115.00 | 74.00 | 124.00 | 106.40 | 94.00 | 97.49 |
| #'s PUNCTURE/oz2 | 3.14 | 3.79 | 5.04 | 4.55 | 4.29 | 4.59 | 3.76 |
| $/#'s OF PUNCTURE | 1.15 | 1.02 | 1.13 | 0.81 | 1.10 | 1.01 | 1.19 |
| | | | | | | | |
| **PUNCTURE 12:1** | | | | | | | |
| 12:1 80 MIL #'s | 57.10 | 66.37 | 31.90 | 60.10 | 52.00 | 47.60 | 60.70 |
| #'s PUNCTURE/oz2 | 1.70 | 2.19 | 2.17 | 2.21 | 2.09 | 2.33 | 2.34 |
| $/#'s OF PUNCTURE | 2.12 | 1.77 | 2.61 | 1.68 | 2.26 | 2.00 | 1.90 |
| | | | | | | | |
| **KNIFE SINGLE EDGE** | | | | | | | |
| Ka_BAR CUT 4 LAYER #'s | 62.90 | 60.40 | 36.70 | 46.98 | 45.94 | 42.59 | 44.86 |
| #'s CUT/oz2 | 1.88 | 1.99 | 2.50 | 1.72 | 1.85 | 2.08 | 1.73 |
| $/#'s CUT | 1.93 | 1.94 | 2.27 | 2.15 | 2.56 | 2.24 | 2.58 |
| | | | | | | | |
| **KNIFE DOUBLE EDGE** | | | | | | | |
| EKCO DAGGER POINT #'s | 17.75 | 17.38 | 17.48 | 17.75 | 17.68 | 12.50 | 14.47 |
| #'s CUT/oz2 | 0.53 | 0.57 | 1.19 | 0.65 | 0.71 | 0.61 | 0.56 |
| $/#'s CUT | 6.83 | 6.75 | 4.77 | 5.68 | 6.65 | 7.62 | 7.99 |
| REF. NO. (Figs. 6,7) | (56) | (62) | (50) | (58) | (60) | (54) | (52) |

Fig. 5

PROTECTIVE FABRIC HAVING HIGH PENETRATION RESISTANCE

BACKGROUND OF THE INVENTION

A. Field of the Invention

The invention relates to a protective fabric having a high resistance to penetration by instruments such as ice picks and the like, and to vestments made from such fabric.

B. Prior Art

Protective clothing is used in a multiplicity of applications to protect the wearer against harm from a variety of objects such as knives, picks, bullets, and the like.

Protective clothing of the type worn by prison guards, among others, must be capable of withstanding assault by a variety of instruments. Typically, they are judged by their resistance to ballistic penetration (e.g., by 0.357 magnum and 9 mm ammunition); dagger cutting; penetration by single and double-edged knives; and puncture by both blunt (e.g., 3:1 ratio of tip diameter to shaft diameter) and sharp (e.g., 12:1 ratio of tip diameter to shaft diameter) instruments such as ice picks and the like. Of these measures of performance, one of the most difficult to achieve is resistance to puncture, particularly by sharp instruments.

Varied approaches have heretofore been utilized to provide the requisite protection. For example, U.S. Pat. No. 5,185,195 teaches the use of a number of layers of fabric secured together by closely spaced rows of stitching. Overlapping ceramic disks are also optionally incorporated into the vestment.

U.S. Pat. No. 4,737,401 teaches formation of a ballistic resistant fabric from high molecular weight fibers of polyolefin, polyvinyl alcohol, and polyacrylonitrile materials. The fibers may additionally be coated. U.S. Pat. No. 4,574,105 teaches the use of both polyester (p-phenylene terepthalamide) yarns and polyamide yarns. U.S. Pat. No. 5,225,241 teaches the enhancement to ballistic penetration by forming a vestment from coated fibers.

Because of the extreme demands made on the materials, they are frequently expensive to produce, both in fabric and in finished form. In addition, processes used to form the fabric and the finished article frequently result in a fabric and an article which is relatively stiff and not readily drapable. Accordingly, the user frequently finds such vestments unduly restrictive and uncomfortable, and often dispenses with their use in situations where good safety practices would otherwise call for them.

DETAILED DESCRIPTION OF THE INVENTION

A. Objects of the Invention

Accordingly, it is an object of the invention to provide a fabric having improved penetration resistance.

Further, it is an object of the invention to provide a fabric having comparatively high resistance to penetration by both blunt and sharp instruments.

Still a further object of the invention is to provide a fabric having enhanced resistance to penetration by both blunt and sharp instruments that is also characterized by acceptable drapability.

Another object of the invention is to provide a fabric that has enhanced resistance to penetration by blunt and sharp instruments and that is characterized by a comparatively low cost per unit of protection provided.

Yet another object of the invention is to provide a vestment having enhanced resistance to penetration by blunt or sharp probes, as well as enhanced resistance to penetration by knives and ballistic penetration.

B. Brief Summary of the Invention

In accordance with the present invention, a protective fabric of high penetration resistance is formed from a plurality of layered, densely woven fabrics, each formed by tightly weaving multifilament yarns to obtain a warp yarn "density" or "cover" in excess of 100% at the center of the fill yarn. Further, the fill yarn density or cover is preferably also in excess of 75% as measured between two warp ends. The yarns themselves preferably comprise a high modulus (less than 5% elongation at the breaking point), high breaking strength (greater than 15 grams per denier) yarn. The warp and fill yarns are preferably twisted, consistent with the maximum breaking strength. Materials which have been found especially suitable for the present invention are the para-aramids (e.g., Kevlar); high density polyethylenes (e.g., Spectra); and liquid crystal polyesters (e.g., Vectran).

"Normal" density fabrics typically are 50×50 (i.e., 50 warp yarns to the inch by 50 fill yarns to the inch) or 70×70, for example, at 200 denier. Such fabrics have little resistance to penetration, even when used in multiple layers. In accordance with the present invention, however, a protective fabric having extremely high penetration resistance is formed by layering a plurality of densely woven fabric sheets of construction ranging from 90×88 to 130×86 at 200×200 denier, and from 100×68 to 130×65 at 200×400 denier. Fabrics at these levels of construction are known as "densely woven", "tightly woven" or "overconstructed", and are known but uncommon. They have heretofore been used in sail cloth but not, to my knowledge, in protective clothing. For use in the present invention, the fabrics are preferably woven from a high-modulus, multi-filament material such as a standard type 29 Kevlar® material. The resultant protective fabrics are characterized by high penetration resistance, good drapability, and relatively low cost per unit of resistance.

The number of layers of basic fabric used in the present invention, of course, depends on the threat against which the wearer is to be protected. For example, protection against penetration by a thin instrument such as an awl is extremely difficult. Yet, with the fabric and construction of the present invention, twenty layers of a 110×67 weave of density 200×400 denier resisted penetration forces of up to 1.6 inch pounds as applied with an ice pick of 0.163 inch diameter. When fifty four layers of this fabric were stacked together, the resultant composite resisted penetration up to an applied awl force of in excess of four hundred inch pounds.

The resistance to penetration and cutting by knives of vestments made from such material is also enhanced by incorporating this fabric into a vestment including additional plies of an outer layer of heavy yarn (e.g., 300–500 denier) with loose weave (e.g., from 15×15 to 18×18); a middle layer of conventional ballistic fabrics (e.g., from 27×27 to 31×31 and from 1000 to 840 denier material); and an innermost or bottom layer of the protective fabric of the present invention.

The dense construction of the fabric layers in the present invention greatly restricts in-plane motion, and thus requires increased out-of-plane extrusion for any significant penetration. The out-of-plane extrusion forces significantly accumulate over successive layers to the extent that further penetration requires the breakage of large numbers of high-modulus, high breaking-strength fibers before further penetration can be achieved. This not only limits penetration by thin, sharp instruments such as awls and picks, but also increases protection against sharp-edged instruments such as knives which must first penetrate before they can cut.

DETAILED DESCRIPTION OF THE INVENTION

The foregoing and other objects and features of the invention will be more readily understood on reference to the following detailed description of the invention, when taken in connection with the accompanying drawings, in which FIGS. 1(A+B) is an illustrative sketch of a cross-section of fabric woven at a normal weaving density and showing an end-on view of warp yarns at the point of shed crossing between two fill yarns (FIG. 1A) and at the center of a fill yarn (FIG. 1B);

FIG. 5 is a chart showing the performance of a number of fabrics as measured by common tests for protective materials;

Figure 1A:
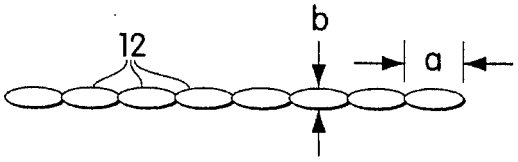
Figure 1B:
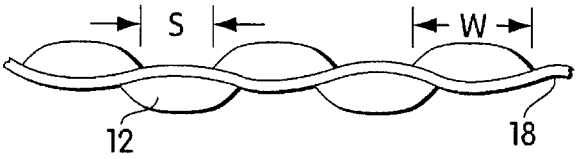

In FIG. 1, a plain woven fabric constructed in accordance with typical weaving practice (e.g., 70 warp threads per inch, 70 fill threads per inch, 200 denier warp, 200 denier fill (hereinafter denoted as a 70×70 (200×200) weave) has a plurality of warp yarns 12 extending lengthwise along the fabric (the lengthwise direction in this case being transverse to the plane of the paper of FIG. 1 so that the warp yarns are shown in cross-section) and traversed at intervals by fill yarns 14.

The yarns used to manufacture the fabric of FIG. 1 are multifilament bundles, generally round in shape. However, as may be seen from FIG. 1, when woven into: a fabric, they assume a somewhat flattened, generally elliptical shape. This shape may be quantified to some degree by determining their "aspect ratio", that is, the ratio of their length "a" (as measured along their major axis or axis of greatest extent) to their width "b" (as measured along their minor axis or axis of least extent), both as measured at the point of shed crossing between two fill yarns as seen in FIG. 1A. For fabrics at normal weaving density, the aspect ratio is much larger than one, i.e., a/b>>1.

A second measure of the yarn shape may be obtained by examining the spacing of the warp yarns as measured at the point of crossing of a fill yarn, i.e., at the center of the fill yarn, and comparing this to the width of the warp yarns at the same location. The spacing between the warp yarns is shown as the distance "s" in FIG. 1A; the width of the warp yarns is shown as the distance "w". For fabrics at normal weaving density, the spacing ratio, s/w, approaches 1.

FIG. 1 is to be contrasted with FIG. 2, which is a tightly or densely woven fabric as used in accordance with the present invention and formed from warp yarns 16 and fill yarns 18. The fabric of FIG. 2 was plain woven from a 200 denier 5z t29 Kevlar multifilament warp ("5z" indicating 5 twists to the inch and "t29" the type number, designating normal Kevlar® in this instance) and a 400 4z t29 Kevlar® multifilament fill yarn at a density of 110 ends per inch warp, 67 picks per inch fill, i.e., a 110×67 (200×400) fabric. As opposed to the roughly oval or elliptical cross sections of the fabric of FIG. 1 at the shed crossings, the fabric of FIG. 2 has a squarer cross section, with as aspect ratio a/b much less than that of the fabric of FIG. 1 and indeed much closer to 1. Further, the spacing ratio, s/w, of the fabric of FIG. 2 is much less than that of the fabric of FIG. 1, and is much less than one, i.e., s/w<<1.

Figure 2A:
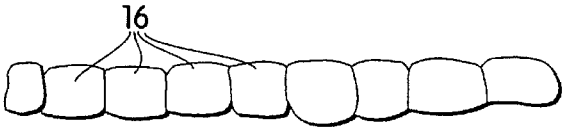
FIGS. 2(A+B) is an illustrative sketch of a cross-section of densely-woven fabric and showing an end-on view of the warp yarns at the point of shed crossing between two fill yarns (FIG. 2A) and at the center of a fill yarn (FIG. 2B)
FIG. 2C is an enlarged illustrative sketch of several of the yarns of FIG. 2A showing the flattened "keystone" structure of the yarns.
Figure 2B:
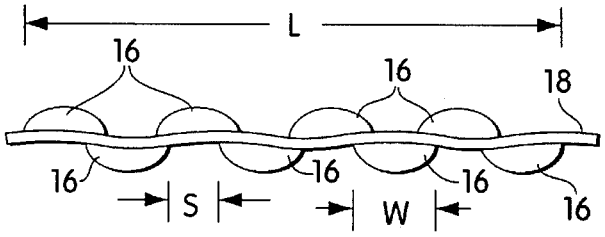
Figure 2C:
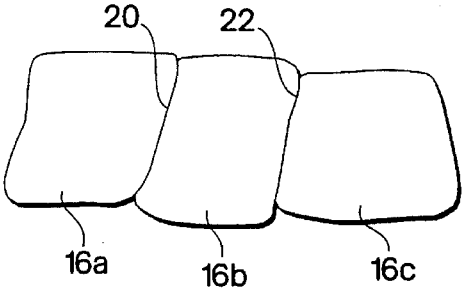

A more detailed Examination of the warp structure of the fabric of FIG. 2 at the shed cross shows that the warp yarns have a "keystone" structure, that is, the yarn cross sections have been distorted by the weaving into roughly square shapes such that adjacent yarns have opposed and complementary slopes at their mating surfaces. This is shown more clearly in FIG. 2C which is an enlarged view of three adjacent yarns from FIG. 2A at the shed crossing. The yarns 16*a*, 16*b*, 16*c* mate together pairwise at common interfaces 20 and 22, respectively. At these interfaces, when traversing the yarn surfaces in a clockwise direction, the right face of the leftmost yarn of a pair, e.g., yarn 16*a*, slopes down and to the left, while the left face of the rightmost yarn of a pair, e.g., yarn 16*b*, slopes up and to the right. The result is an interlocking structure that resists yarn movement out of the plane of the fabric, and thus provides significant penetration resistance.

Figure 3:
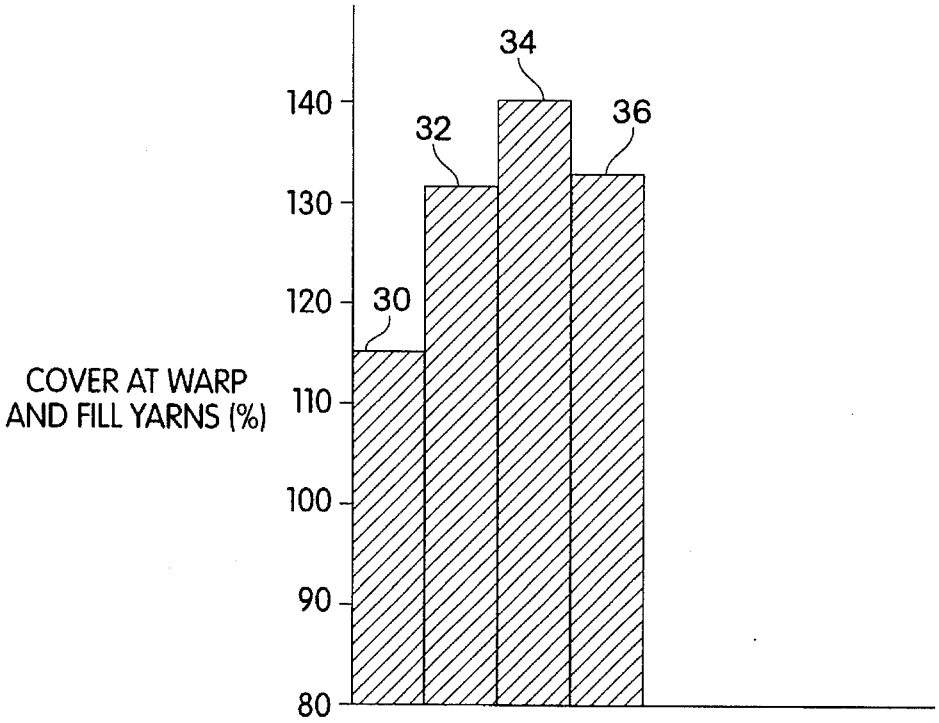
FIG. 3 is a graph showing the "cover" of various density weaves.

Another indicator of the geometric structure of the fabric of the present invention is the amount of overlap or "cover" between adjacent warp yarns as measured at the fill crossing. Referring to FIG. 2B, the cover may be determined as the sum of each of the widths w of the yarns in a given cross section, divided by the length, "l", of the cross section. Referring now to FIG. 3, the cover of a typical normal fabric (70×70, 200×200) as well as that of several densely woven yarns in accordance with the present invention is shown. As seen in FIG. 3, the cover 30 of the normal fabric is of the order of approximately 115%, with 100% indicating essentially no overlap, on average. In contrast, the cover of densely woven fabrics in accordance with the present invention is significantly higher. Thus, the cover 32 of a 90×88 (200×200) fabric is of the order of 130%. The cover 36 of a 110×67 (200×400) fabric is seen to be just slightly in excess of the 90×88 fabric, while the cover 34 of a 131×65 (200×400) fabric is even higher, approximately 140%.

Figure 4:
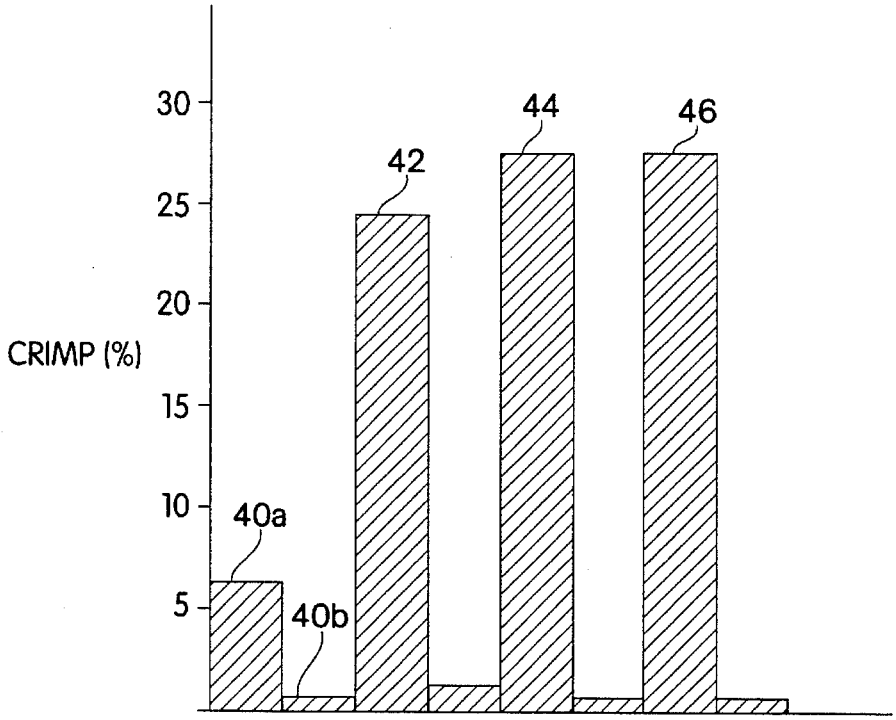
FIG. 4 is a graph showing the "crimp" of various density weaves.

Still another measure of the structure of the fabric of the present invention is its "crimp" in the warp direction, defined as the length of a given section of fabric along the warp direction divided by the length of the warp yarn when freed from the section. FIG. 4 shows the amount of crimp for four different fabrics, namely, a 70×70 (200×200) (indicated as element 40), a 90×88 (200×200) (element 42), a 110×67 (200×400) (element 44), and a 131×65 (200×400) (element 46) fabric. The crimp along both the warp (e.g., 40*a*) and fill (e.g., 40*b*) directions for each of these fabrics is given. It is readily seen that the crimp in the normal fabric (element 40) is significantly less than that of the densely woven fabrics used in the present invention. (42, 44, 46).

FIG. 5 summarizes the performance of a number of fabrics with respect to several generally accepted performance measures for protective fabrics. Four test conditions are shown, namely, penetration with a 3:1 instrument; penetration with a 12:1 instrument; cutting with a single edge knife; and cutting with a double edge knife. The penetration resistance in the 3:1 test is measured by the standard ASTM four layer penetration test; that for the 12:1 test is for penetration by an 80 mil probe. The single edge knife test is the standard Ka_bar cut four layer test, while that for the double-edge knife is the Ekco dagger point test. In each case the penetration or cutting resistance is measured in pounds of force. The resistance per square ounce of fabric is also tabulated, as well as the effective cost of the fabric per pound of resistance.

Figure 6:
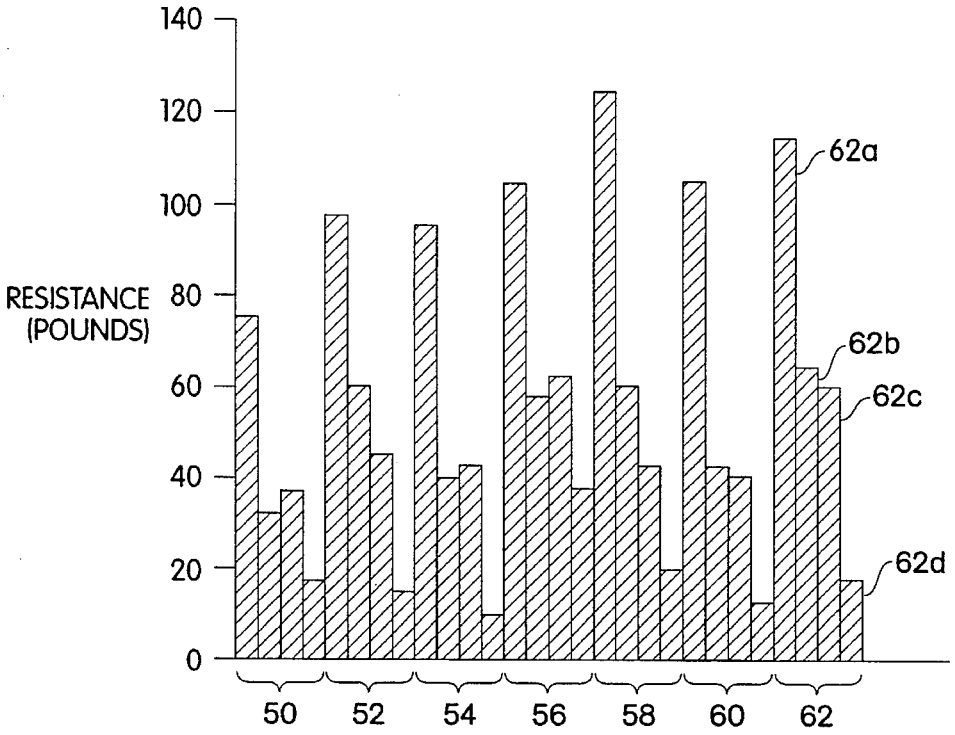
FIG. 6 is a graph ! showing the resistance to penetration of the fabrics of FIG. 5.
Figure 7:
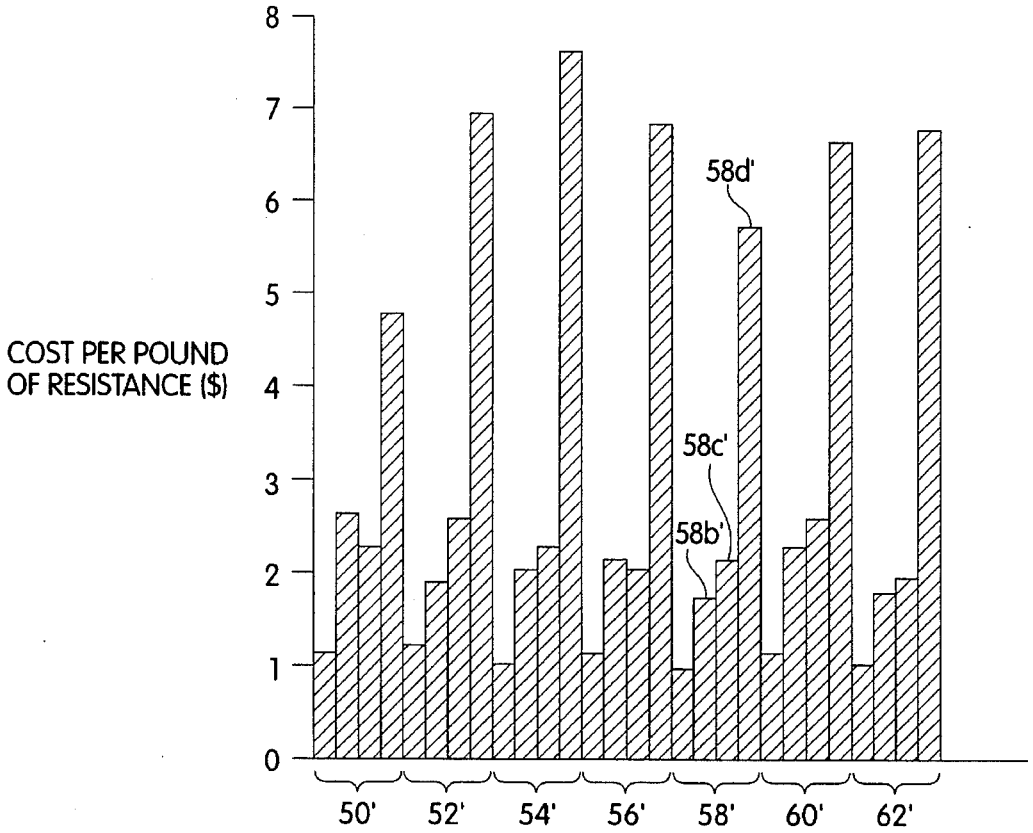
FIG. 7 is a graph showing the cost/benefit performance of the fabrics of FIG. 5.

The latter figure, as well as the resistance in pounds of the various materials listed in FIG. 5, are shown graphically in FIGS. 6 and 7. In each figure, four data points are shown for each fabric material listed in FIG. 5. For example, in FIG. 6, the material identified as a 131×65 (200 5z t29, 200 10z t2) fabric in FIG. 5 has a 3:1 penetration resistance as shown at 62*a;* a 12:1 penetration resistance as shown at 62*b;* a single edge knife resistance as shown at 62*c;* and a double edge knife resistance as shown at 62*d.*

From FIG. 6, it will dearly be seen that the 110×67 (200×400) fabric (58) is clearly superior in the 3:1 penetration test, and is better than all but one of the other fabrics in the 12:1 penetration test. Additionally, it has a fairly high rating in the singles edge knife test, and is as strong as any other fabric in the double edge knife test. Thus it offers superior penetration resistance, While retaining excellent knife edge resistance.

An important consideration in a protective fabric is its cost per unit of protection. This is shown in FIG. 7 for the various fabrics of FIG. 5 and for each of the four threats. For example, for the 110×67 (200×400) material discussed above, the cost per pound of resistance of this material for the four types of threats, namely, 3:1, 12:1, single edge knife and double edge knife is shown at 58*a'*, 58*b'*, 58*c'*, and 58*d'*, respectively. It will be seen from this that the 110×67 fabric has superior cost performance in the 3:1 and 12:1 penetration test, while retaining excellent relative performance in the single and double edge knife tests.

The number of layers of the base fabric, and the specific type of fabric of each layer, will vary with the types of threat against which protection is to be maximized. For example, for protection primarily against harm by penetration, in excess of thirty layers of a 110×67 (200×400) fabric will generally be effective. For protection against multiple threats, such as both penetration and cutting (knife threats), a combination of layers of protective fabric of varied but dense weaving may be used, including a coated base fabric as described in more detail below.

As discussed above, the preceding fabric structures offer excellent resistance to puncture and additionally provides significant resistance to penetration by sharp ,knives. The resistance to the latter can be enhanced even more in accordance with a further embodiment of the present invention illustrated in FIG. 8. In that figure, a densely woven fabric is shown coated in interrupted or patterned fashion with a high modulus lamination epoxy spread over the fabric at a rate of 2–5 ounces per square yard. The pattern illustrated in FIG. 8 for example comprises a plurality of rectangular coated areas or "islands" 70 separated by uncoated "streets" 72. The "islands" provide high in-plane resistance to the flat faces of a knife attempting to penetrate the material, and thus enhance resistance to penetration, while the "streets" provide a bending capability to the otherwise rigid material.

In a preferred embodiment of this aspect of the invention, the base fabric comprised a 110×67 densely woven fabric coated with a Gougeon Bros. type 126 epoxy resin applied at a rate of from two to five ounces per square yard. The resin was set by means of a Gougeon Bros. type 226 hardener, with curing first at room temperature and then at 140 degrees Fahrenheit. This material has a tensile modulus on the order of $5\times10^5$.

Figure 9:
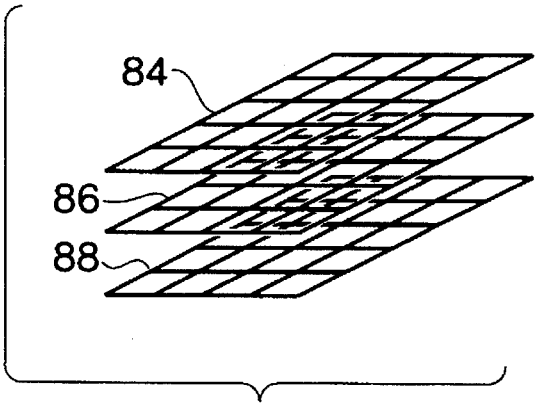
FIG. 9 is a sketch of a plurality of the fabric sheets of FIG. 8 assembled into a stack for forming a vestment therefrom.

The patterned structure is preferably formed on the base fabric in a manner similar to photographic methods, i.e., a material resistant to bonding to the epoxy (e.g., paraffin or the like) is first laid down on the fabric in the pattern of the streets. This may be accomplished by silk screening, gravure printing, or other known techniques. The epoxy is then applied in a thin, even layer over the material and hardened. The resist material is then removed, exposing the underlying, uncoated streets between the coated lands. In the test example described herein, the "islands" were on the order of one inch square, while the streets were on the order of one-sixteenth wide. In forming a protective garment, the base structure is stacked in a plurality of layers, e.g., layers 84, 86, and 88 as shown in FIG. 9, and cut to site. The layers may be joined by any of various well-known means, such as stitching them together, etc.

The resultant structure was tested by stacking 14 sheets of this material and subjecting the stack to a standard H B White drop test. This test uses a 16.2 pound weight to drive a Russell boning knife into the layered stack. The height from which the weight must be dropped in order to penetrate a stated number of layers is a measure of the penetration resistance of the stack. In the present case, it was found that the knife failed to penetrate the fourteenth layer when the drop was made from up to nearly 2.5 feet above the stack, corresponding to a penetration energy of 40 foot pounds. Indeed, the knife buckled in consequence of the resistance provided by the stack.

Figure 8:
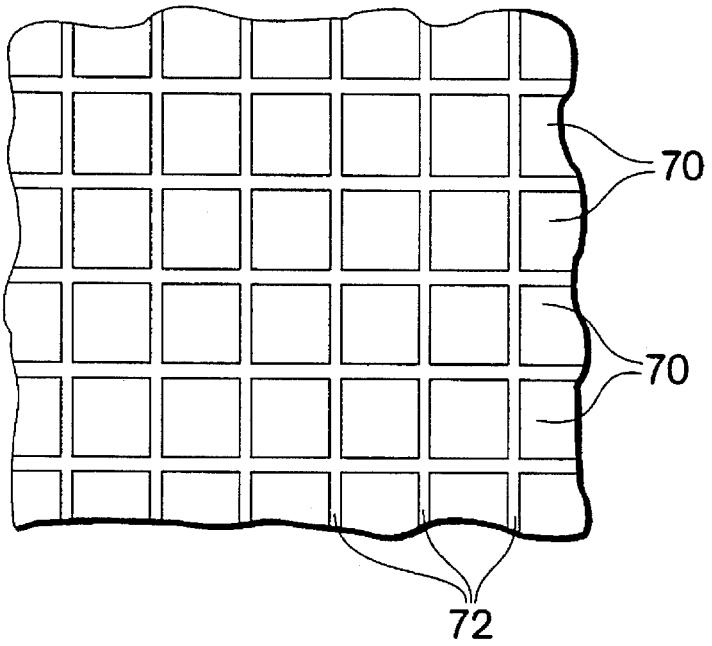
FIG. 8 is a sketch of an alternative form of fabric used in constructing protective fabric in accordance with present invention and having particularly enhanced resistance to cutting penetration of the type encountered with thin, sharp knives.

The embodiment of FIG. 8 does not provide the high drapability of the fabric structures previously described, but it nonetheless does provide adequate drapability accompanied by an extremely high degree of protection. The "streets" of the fabric not only serve as hinge points for bending, but also provide pathways for "breathing", thus contributing to a more comfortable wear for the user. The "islands" may vary in size from fractions of an inch along the maximum dimension, to inches; the streets typically are narrow, i.e., on the order of fractions of an inch. Further, the islands may take any shape,. i.e., square, rectangular, diamond, circular, etc. The smaller the islands, the more hinge points for bending are provided; however, this also reduces the ratio of the coated area (islands) to uncoated area (streets) and thus requires a greater number of layers to obtain a desired level of protection. Of course, care must also be taken to avoid alignment of the streets in successive layers, since such alignment also reduces the effective protection obtained from the material.

What is claimed is:

1. A protective fabric having high penetration resistance, comprising a plurality of layers of tightly woven base fabric having a density in excess of 80 threads/inch in at least of the warp and fill directions and having warp yarn cover of at least 100% at the fill pick.

2. The protective fabric of claim 1 in which said yarn comprises a yarn having a high modulus and a high breaking strength.

3. The protective fabric of claim 2 in which said yarn is chosen from the group consisting of para-aramids, high density polyethylenes, and liquid crystal polyesters.

4. The protective fabric of claim 3 which comprises at least ten layers of base fabric.

5. The protective fabric of claim 1 in which said yarn comprises normal Kevlar®.

6. The protective fabric of claim 1 in which said fill cover is at least 75% at the warp yarn.

7. The protective fabric of claim 1 in which said fill cover is at least 85% at the warp yarn.

8. The protective fabric of claim 1 in which said fill cover is at least 100% at the warp yarn.

9. The protective fabric of claim 1 in which said fill cover is in excess of 125% at the warp yarn.

10. An article of clothing having high penetration resistance, comprising a plurality of layers of base fabric having a density in excess of 80 threads/inch in at least of the warp and fill directions and having a warp cover at the fill pick in excess of 100% and a fill cover at the warp yarn in excess of 85%.

11. An article of clothing according to claim 10 which comprises at least ten layers of said base fabric.

12. A protective fabric of high penetration resistance, comprising a plurality of layers of fabric formed from multifilament warp yarns plain woven with fill yarns at such a density as to distort the warp yarns into a keystone structure in which the warp yarns significantly resist movement out of the plane of the fabric in response to force from an otherwise penetrating object.

13. A protective fabric according to claim 12 in which the aspect ratio of said warp fiber as measured at the shed crossing is less than 1.3.

14. A protective fabric according to claim 13 in which said aspect ratio is approximately 1.

15. A protective fabric according to claim 10 in which the spacing ratio of said warp fibers as measured at the fill crossing is significantly less than 1.

16. A protective fabric according to claim 10 in which said spacing ratio is less than 0.7.

17. A protective fabric according to claim 10 in which the density of said warp fibers is in excess of 90 ends per inch.

18. A protective fabric according to claim 17 in which the density of said warp fibers is in excess of 100 ends per inch.

19. A protective garment providing substantial resistance to penetration by sharp instruments, including a plurality of layers of plain woven protective base fabric formed of multifilament yarns woven at a density sufficient to distort the warp yarns into a keystone structure at the shed crossing.

20. A garment according to claim 19 in which said warp yarns have an aspect ratio as measured at the shed crossing of less than 1.3.

21. A garment according to claim 20 in which said warp yarns have an aspect ratio as measured at the shed crossing of approximately 1.

22. A garment according to claim 19 in which said warp warns are woven at a density in excess of 90 ends per inch.

23. A garment according to claim 19 in which said warp warns are woven at a density on the order of 110 ends per inch.

24. A garment according to claim 19 in which said warp warns are formed from a Kevlar® material.

25. A protective fabric comprising a plurality of layers of a tightly woven base fabric, said base fabric constructed from a high modulus tightly woven material having warp yarn cover of at least 100% at the fill pick and having a repeatedly interrupted coating of a plastic material providing flexure points to the base fabric at the areas of interruption.

26. A protective fabric according to claim 25 in which said coating comprises an epoxy material.

27. A protective fabric according to claim 26 in which said coating has a modulus in excess of $10^5$.

28. A protective fabric according to claim 26 in which said warp warns are woven at a density on the order of at least 110 ends per inch.

29. A protective fabric according to claim 28 which comprises at least ten layers of base fabric.

30. A protective fabric according to claim 28 in which said warp warns are formed from a Kevlar® material.

* * * * *